US005191779A

United States Patent [19]

Imazu et al.

[11] Patent Number: 5,191,779

[45] Date of Patent: Mar. 9, 1993

[54] METHOD OF PRODUCING A METALLIC CAN USING A SATURATED BRANCHED CHAIN CONTAINING HYDROCARBON LUBRICANT

[75] Inventors: Katsuhiro Imazu; Kazuhiro Sato; Takurou Ito, all of Yokohama; Shunji Kaneko, Ebina; Toshio Sue, Tokyo, all of Japan

[73] Assignee: Toyo Seikan Kaisha, Ltd., Tokyo, Japan

[21] Appl. No.: 743,350

[22] PCT Filed: Dec. 6, 1990

[86] PCT No.: PCT/JP90/01595

§ 371 Date: Aug. 5, 1991

§ 102(e) Date: Aug. 5, 1991

[87] PCT Pub. No.: WO91/08066

PCT Pub. Date: Jun. 13, 1991

[30] Foreign Application Priority Data

Dec. 6, 1989 [JP] Japan ..... 1-315205
Nov. 1, 1990 [JP] Japan ..... 2-293680

[51] Int. Cl.[5] ..... B21B 45/00
[52] U.S. Cl. ..... 72/46; 72/42
[58] Field of Search ..... 585/9, 13; 72/42, 46, 72/41

[56] References Cited

U.S. PATENT DOCUMENTS

| | | | |
|---|---|---|---|
| 2,245,639 | 6/1941 | Bartlett | 585/9 |
| 2,590,451 | 3/1952 | Perry | 72/42 |
| 3,124,531 | 3/1964 | Whetzel | 72/42 |
| 3,162,310 | 12/1964 | Tiberiis | 72/41 |
| 3,250,103 | 5/1966 | Beaubien | 72/42 |
| 3,258,319 | 5/1966 | Cox | 585/9 |
| 3,832,962 | 9/1974 | Rolles | 72/46 |
| 3,984,599 | 10/1976 | Norton | 585/9 |
| 4,428,851 | 1/1984 | Hisamoto et al. | 72/42 |

FOREIGN PATENT DOCUMENTS

| | | | |
|---|---|---|---|
| 2849867 | 5/1979 | Fed. Rep. of Germany | 72/42 |
| 50-97632 | 8/1975 | Japan . | |
| 56-84103 | 7/1981 | Japan . | |
| 61-26695 | 2/1986 | Japan . | |

*Primary Examiner*—Lowell A. Larson
*Assistant Examiner*—Michael J. McKeon
*Attorney, Agent, or Firm*—Sughrue, Mion, Zinn, Macpeak & Seas

[57] ABSTRACT

In a method of producing a metallic container by subjecting a metallic material having an organic resin coating to single-staged or multiple-staged drawing, uniformly coating a lubricant on the surface of the organic resin coating of the metallic material and draw-forming the coated material, according to the present invention, a high lubricating property is obtained at the time of drawing by using a small amount of a saturated hydrocarbon as the lubricant, and by simply heating the formed can, a major portion of the lubricant can be removed and the degreasing and washing steps or the subsequent drying step essential in the conventional method, can be omitted, with the result that the printability or the flavor-retaining property can be markedly improved, and consumption of water resource and energy resource can be reduced and a high effect of preventing environmental pollution can be attained.

8 Claims, 1 Drawing Sheet

Figure 1:
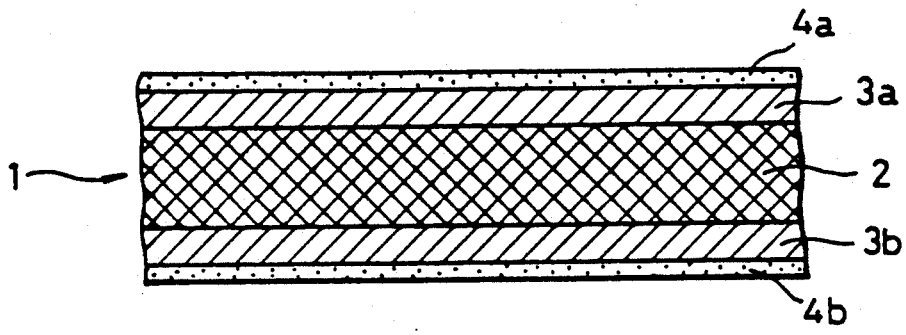

METHOD OF PRODUCING A METALLIC CAN USING A SATURATED BRANCHED CHAIN CONTAINING HYDROCARBON LUBRICANT

DESCRIPTION

1. Technical Field

This invention relates to a method of producing a metallic can by drawing a metallic material having an organic resin coating, and more particularly, the invention relates to a method for improving the printability while omitting degreasing and washing after drawing.

2. Technical Background

In the past, the production of side seamless cans was widely conducted by subjecting a metallic material such as an aluminum plate, a tin plate or a tin-free steel plate to at least one-step drawing between a drawing die and a punch to form a can comprising a side seamless barrel portion and a bottom portion integrally connected to the barrel without seam.

Coating treatment of a draw-formed can is a complicated operation, and dissipation of the solvent poses a problem of environmental pollution at the time of spray coating. Therefore, there is widely adopted a method in which an organic resin coating is applied on the surface of the metallic material by lamination of a resin film or coating of an organic resin paint.

However, even when a metallic material having an organic coating formed thereon is subjected to draw forming, in order to improve drawability and prevent damage of the coating at the time of the drawing, it is necessary to apply a lubricant to the surface of the material.

Japanese Examined Pat. Publication No. 01-36519 proposed by the present inventors teaches that in drawing a metallic material coated with an organic resin, an aqueous oil-in-water emulsion prepared from a liquid glyceride, ethanol and a nonionic surface active agent is uniformly applied on the coated surface, and the can after drawing is washed with water in a warm state.

When a metallic material coated with an organic resin is further coated with an ordinary lubricant to improve the drawability, the lubricant on the coating is difficult to remove by degreasing. The lubricant remaining on the coating causes a problem of impairing the delicate flavor of drinks which is an important feature for the drinks. The above prior art technique is significant in that it increases the degreasability and washability while increasing the drawability.

However, the conventional method indispensably requires two steps, that is, can degreasing and washing after drawing and drying after washing. The step number is therefore increased, and the prior art is not sufficiently satisfactory in the point that it requires water resource and thermal energy.

It is conceivable to select a lubricant having an excellent flavor retaining property and being capable of reducing the bearing required for degreasing and washing to a minimum level. In this case, the lubricant left on the surface of the film markedly impairs the printability of the outer surface of the can, and the adhesion of the ink layer to the can is reduced.

DISCLOSURE OF THE INVENTION

It is therefore an object of this invention to eliminate the defects of the conventional method of producing a metallic can by drawing from a metallic material having an organic resin coating, and to provide a method for improving the printability and the flavor retaining property while omitting the degreasing and washing steps after drawing.

According to this invention, there is provided a method of producing a metallic can by subjecting a metallic material having an organic resin coating to single-staged or multiple-staged drawing, which comprises uniformly coating a saturated hydrocarbon lubricant on the surface of the organic resin coating of the material, drawing the material after coating, heating the can obtained by drawing, and thereby volatilizing a major portion of the lubricant adhering to the can.

The saturated hydrocarbon lubricant is a hydrocarbon lubricant having branched chains, in which the branches are contained in an amount of at least one branch per 2 to 10 carbon atoms of the main chain. Further, in the lubricant used in the present invention, the number of branched chains having a carbon number of 1 is at least 70% of the number of entire branched chains present in the lubricant.

In the present invention, among many lubricants, a saturated hydrocarbon lubricant, especially a saturated hydrocarbon lubricant having branched chains, is selected. This lubricant is applied to the surface of a material having an organic resin coating. This is because (1) this lubricant has a heat-volatility and can be easily removed by volatilization upon heating, (2) an excellent drawability (press drawability) can be given to the metallic material having an organic resin coating, (3) the lubrican has an excellent flavor retaining property, and even when it is left on the coating, it does not give any strange taste or offensive smell to can contents, and (4) the lubricant is excellent in sanitary characteristics, as is admitted as a food additive.

More specifically, the above-mentioned saturated hydrocarbon lubricant is characterized in that it gives a better drawability by a coating amount much smaller than in case of other lubricants. It is considered that the lubricant used in this invention exerts a liquid lubricant action or an action resembling a liquid lubricant action, and the oil film strength is considerably high. Since the amount coated of the lubricant is considerably small, the removal after drawing is easy. The influence of the remaining lubricant in the coating, for example, the influence on printability, is very small.

Since saturated hydrocarbons have a larger volatility than polar compounds and absorption of these saturated hydrocarbons in the organic coating and their swelling action are smaller than in case of polar compounds, when compared based on the same molecular weight, volatilization and removal by heating can be performed in a short time. This tendency is especially prominent in branched chain-containing hydrocarbon lubricants. The branched chain-containing hydrocarbon lubricant contains a tertiary carbon atom, and since the cleavage of the branched chain takes place at the portion of this tertiary carbon atom, the molecular weight of the lubricant is reduced. This is another reason why volatilization occurs easily. These actions are especially marked when the organic resin coating is composed of a resin film. particularly a polyester film.

In the present invention, an organic resin film-coated metallic material coated with the saturated hydrocarbon lubricant is drawn by a known means. The can obtained by drawing is heated to volatilize a major portion of the adhering lubricant. By volatilizing and removing a major portion of the lubricant, the printability of the can surface is markedly improved and as a result, the adhesion of a printing ink or a finishing varnish increases markedly. Many of lubricants for draw forming have a parting action and they exert a function of imparting releasability between the organic resin coating and the printing ink layer. In the present invention, since the saturated hydrocarbon lubricant used is easy to remove by heating, the majority of the lubricant is removed easily and the above influence is very small.

Even if a small amount of the saturated hydrocarbon lubricant remains, since the lubricant has a releasing action much smaller than other lubricants, it does not give a strange taste or a bad smell to the can contents. Thus, a can having an excellent printability and an excellent flavor retaining property can be provided.

Thus, in the present invention, the degreasing and washing steps essential in the conventional drawing method can be omitted. This results in saving of water resource, and reduction of the burden of washing and draining treatments. Furthermore, rusting of the metal, which occurs at the time of degreasing and washing, can be prevented. Thus, many advantages can be attained.

Only sensible heat for elevating the temperature of a can having a small specific heat to a predetermined level and latent heat for volatilizing a very small amount of the lubricant are required for heating the formed can. As compared with the case of drying of a can to which water droplets adhere, a thermal energy can be markedly reduced. This heating also gives an advantage that the strain remaining in the organic resin coating after drawing can be reduced, and the adhesiveness or strength of the coating can be increased.

BRIEF DESCRIPTION OF THE ACCOMPANYING DRAWINGS

Figure 2:
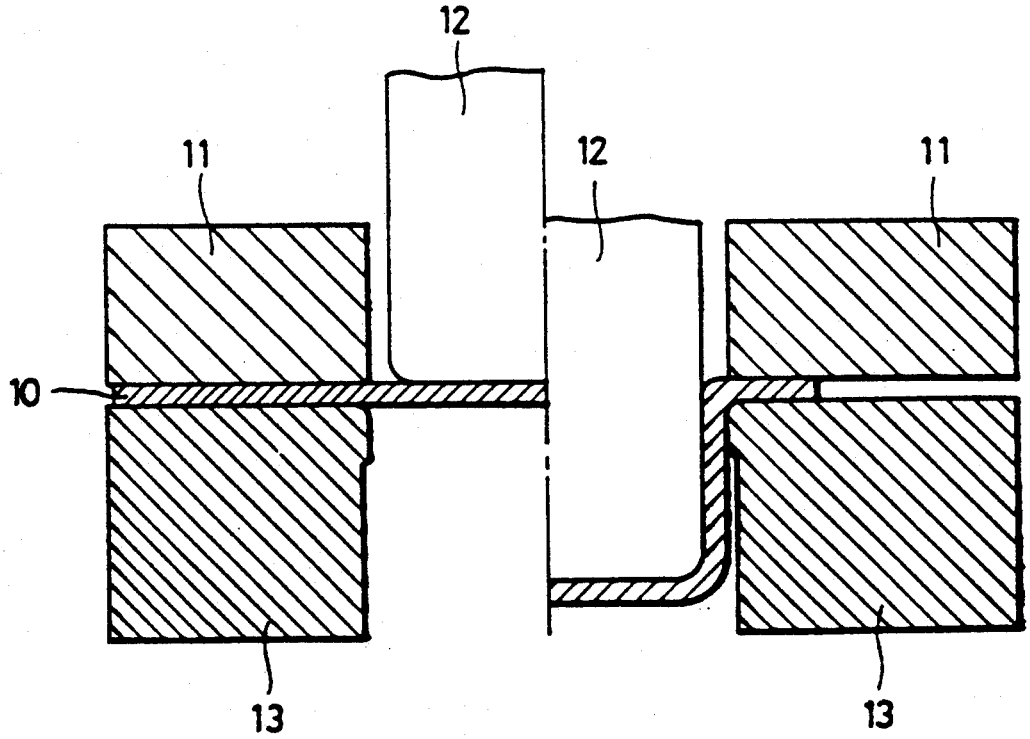

FIG. 1 is a sectional view showing the structure of a metallic material used in the method of this invention, FIG. 2 is an explanatory view (sectional view) explaining the operation of drawing a metallic material.

BEST MODE OF PRACTICING THE INVENTION

In FIG. 1 showing the sectional structure of a metallic material to be press-formed. This metallic material 1 is composed of a metallic substrate 2 of an aluminium plate, a tin-free steel or a tin plate having organic resin coatings 3*a* and 3*b* formed on both the surfaces of the substrate 2.

In the present invention, prior to press-drawing, layers 4*a* and 4*b* of a saturated hydrocarbon lubricant are uniformly coated on the surfaces of organic resin coatings 3*a* and 3*b*.

The saturated hydrocarbon lubricant can be any of known ones. Examples of the lubricant are paraffin wax, microcrystalline wax, liquid paraffin, petrolatum, polyethylene wax, polypropylene wax, and ethylene-propylene wax.

In the branched chain-containing hydrocarbon lubricant used in this invention, it is preferred that at least one branched chain be present per 2 to 10 carbon atoms of the main chain. Most of branched chains preferably contain one carbon atom, and the number of branched chains having one carbon atom is at least 70%, especially at least 90%, of the number of entire branched chains present in the lubricant. Such a branched chain-containing hydrocarbon lubricant has a tertiary carbon atom properly in the main chain, and in the portion of this carbon atom, simple branched chains are cleft to reduce the molecular weight, and volatilization is therefore considered to be performed easily.

As the lubricant, petrolatum, especially white petrolatum (vaseline), is especially preferable.

The melting point of the lubricant, depends upon the oxidized state and the like, but is preferably 35° to 80° C., especially 38° to 60° C., and the molecular weight (weight average) is preferably 150 to 700.

The lubricant of the present invention is markedly advantageous in that even if the amount of the lubricant coated on the surface of the organic resin coating is very small, the draw formability is highly improved. For example, if the amount of the coating is 0.4 to 10 mg/dm$^2$, especially 0.5 to 2.0 mg/dm$^2$, a satisfactory result can be obtained. If the amount of the coating is smaller than the amount of the above range, the lubricating property is insufficient, and if the coating amount exceeds the above range, a long period of time is required for the volatilization.

Coating of the lubricant is conveniently performed, for example, by spray coating the lubricant in a liquid state on the metallic material having an organic resin coating or by electrostatically atomizing and coating the lubricant. Furthermore, roller coating can be adopted.

The metallic material used in this invention includes various surface-treated steel sheets the light metal sheets such as an aluminum plate.

An example of the surface-treated steel sheets is one prepared by annealing a cold-rolled steel sheet, secondarily cold-rolling it, and subjecting it to at least one surface treatment selected from zinc plating, tin plating, nickel plating, electrolytic chromate treatment and chromic acid treatment. One preferred example of the surface-treated steel sheet is an electrolytically chromate-treated steel sheet having a metallic chromium layer in an amount of 10 to 200 mg/m$^2$ and a chromate oxide layer in an amount of 1 to 50 mg/m$^2$ (calculated as metallic chromium), and this has an excellent combination of coating adhesion and corrosion resistance. Another example of the surface-treated steel plate is a hard tin plate containing tin in an amount of 0.5 to 11.2 g/m$^2$. This tin plate is desirably subjected to a chromic acid treatment or a chromic acid/phosphoric acid treatment so that the amount of chromium, calculated as metallic chromium, is 1 to 30 mg/m$^2$.

As another examples, there are mentioned aluminum-coated steel plates formed by deposition of aluminum or press-bonding of aluminum.

As the light metal plate, a pure aluminum plate and aluminum alloy plates are used. An aluminum alloy plate having excellent corrosion resistance and processability comprises 0.2 to 1.5% by weight of Mn, 0.8 to 5% by weight of Mg, 0.25 to 0.3% by weight of Zn, and 0.15 to 0.25% by weight of Cu, with the balance being Al. These light metal plates are desirably treated with chromic acid or chromic acid/phosphoric acid so that the amount of chromium is 20 to 300 mg/m$^2$ calculated as metallic chromium.

The blank thickness (TB) of the metallic plate differs depending upon the type of the metal, the use of the container or its size, but the metal plate should preferably have a thickness of 0.10 to 0.50 mm in general. In particular, a surface-treated steel sheet having a thickness of 0.10 to 0.30 mm and a light metal plate having a thickness of 0.15 to 0.40 mm are preferably used.

In the present invention, resin films and resin coatings can be preferably used as the organic resin coating formed on the metal plate. Examples of thermoplastic resin films include films of olefinic resins such as polyethylene, polypropylene, an ethylene-propylene copolymer, an ethylene-vinyl acetate copolymer, an ethylene-acrylate copolymer and an ionomer, polyesters such as polyethylene terephthalate, polybutylene terephthalate, polybutylene terephthalate and an ethylene terephthalate/isophthalate copolymer, polyamides such as nylon 6, nylon 6.6, nylon 11 and nylon 12, polyvinyl chloride, and polyvinylidene chloride.

In the present invention, an inorganic filler (pigment) may be included in the coating layer of the thermoplastic resin to hide the metal plate and to promote transmission of the blank holding power to the metal plate at the time of drawing and re-drawing.

Examples of the inorganic filler used in this invention include inorganic white pigments such as rutile or anatase titanium dioxide, zinc flower and gross white, white body extender pigments such as baryta, precipitated baryta sulfate, calcium carbonate, gypsum, precipitated silica, aerosil, talc, calcined or uncalcined clay, barium carbonate, synhetic or natural mica, synthetic silicate and magnerium carbonate, black pigments such as carbon black and magnetite, red pigments such as red iron oxide, yellow pigments such as sienna, and blue pigments such as ultramarine and cobalt blue. The inorganic filler can be incorporated in an amount of 10 to 500% by weight, especially 10 to 300% by weight, based on the resin.

Coating of the resin film on the metal plate is performed by a heat melting method, a dry lamination method or an extrusion coating method. Where adhesiveness (heat-fusion bondability) is poor between the coated resin and the metal plate, it is possible to interpose a urethane adhesive, an epoxy adhesive, an acid-modified olefin resin adhesive, a copolyamide adhesive or a copolyester adhesive between them.

The crystalline thermoplastic resin desirably has a thickness of 3 to 50 μm, especially 5 to 40 μm.

In the case of using a film for heat bonding, the film may be undrawn or drawn.

Any of protecting paints composed of thermosetting and thermoplastic resins can be used for formation of a protective coating. For example, there can be mentioned modified epoxy paints such as phenol-epoxy paints and amino-epoxy paints, vinyl or modified vinyl paints such as a vinyl chloride-vinyl acetate copolymer, a saponified vinyl chloride-vinyl acetate copolymer, a vinyl chloride-vinyl acetate-maleic anhydride copolymer and an epoxy-modified, epoxyamino-modified or epoxyphenol-modified vinyl resin, acrylic resin-type paints, and synthetic rubber paints such as a styrene-butadiene copolymer. They can be used either singly or in the form of a mixture of at least two of them.

The paint is applied to the metallic material in the form of an organic solvent solution such as an enamel or a lacquer or an aqueous dispersion or aqueous solution to the metallic material by roller coating, spray coating, dip coating, electrostatic coating or electrophoretic coating. Of course, when the resin paint is thermosetting, the paint may be baked as required.

From the viewpoint of increasing corrosion resistance and drawability, the organic coating should desirably have a thickness (in a dried condition) of 2 to 30 μm, especially 3 to 20 μm.

According to this invention, as shown in FIG. 2, an organic resin coating-applied metallic material 10 coated with a specific lubricant is press-formed between a punch 12 and a die 13 which are relatively movable in the axial direction while it is pressed by a blank holder 11 to thereby form a seamless cup having a bottom.

In the present invention, press forming is performed several times until the desired shape and the desired height/diameter ratio are attained while gradually reducing the punch and die diameters.

In this case, the draw ratio defined by the following formula $$\text{Draw ratio} = \frac{\text{diameter before processing}}{\text{diameter after processing}}$$

becomes 1.20 to 2.10, especially 1.30 to 1.90, by one pressing step, and the entire draw ratio desirably becomes 1.5 to 3.00, especially 1.80 to 2.70. At the final deep drawing-step, the side wall portion is bend-pressed to reduce the thickness of the side wall portion so that the TB/TW (TB is the thickness of the bottom wall, and TW is the thickness of the side wall becomes 1.0 to 1.60.

The draw-formed can is subjected to trimming processing, neck-in processing and flange processing to form a can for double wrap seaming.

In the present invention, at an optional stage after drawing and before printing of the outside surface, the can is heated to volatilize the lubricant. The temperature at which the can is heated differs depending upon the type of the lubricant or the type of the organic resin coating. However, generally, the heating temperature is 100° to 240° C., especially 150° to 230° C., and below the melting point and softening point of the resin. Heating should be such that a major portion of the lubricant can be volatilized. The heating time depends upon the coated amount of the lubricant, but it is generally 0.5 to 15 minutes, especially in the range of from 1 to 10 minutes. The heating atmosphere is generally a transferred heat atmosphere, and for example, as the heating method is advantageously adopted a forced air circulating drying method using an oven.

EXAMPLES

The present invention will now be explained by the following examples.

The methods of evaluating metal containers used in the examples are described below.

(Determination of Amount of Volatilization)

The formed metallic container was filled with diethyl ether, and preserved for 24 hours at room temperature to extract the lubricant. The extract was concentrated by using a rotary evaporator, and dried to a solid. The residue was dissolved in hexane.

In the case of a branched paraffin, the solution was quantitatively analyzed by gas chromatography, and the amount of the remaining branched paraffin was determined. The difference of the determined amount from the amount in the coating was determined to obtain the amount of volatilization.

In the case of palm oil, a glyceride decomposed methyl ester method using sodium methoxide-methanol/boron fluoride-methanol was adopted and the amount of the residue palm oil was determined by gas chromatography, and the amount of the volatilized palm oil was measured by the difference from the amount in the coating.

(Evaluation of Flavor)

Distilled water was filled in a metallic container, and then stored for one month at 37° C. Then a flavor test was performed by a panel of 20 experts. The results are shown by "X" where there was a change in the flavor, and "○" where there was no change in the flavor.

EXAMPLE 1

A steel sheet having a blank thickness of 0.18 mm was electrolytically treated with chromic acid. The inside and outside of the steel sheet were laminated with a PET film, and the sheet was coated uniformly with 1.0 mg/dm$^2$ of branched paraffin (containing one branched chain per four carbon atoms in the main chain on an average and containing at least 90% of branched chains having one carbon atom, and having a melting point of 45° C.). Thereafter, the laminated material was drawn by ordinary pressing forming so that the total draw ratio was 2.7 and the outside diameter was 66 mm, whereby a metallic container was obtained.

In the course of forming this metallic container, the press processability was evaluated.

This metallic container was heat-treated at 220° C. for 4 minutes by using an ordinary gas oven, and the amount of the lubricant volatilized from the metallic container was measured.

The metallic container was subjected to curved surface printing, and printability characteristics such as the the ink acceptability and the ink repellency were evaluated. The metallic container was also subjected to the flavor test.

The results are shown in Table 1.

EXAMPLE 2

A metallic container was produced and evaluated in the same manner as described in Example 1 except that the coated amount of the branched paraffin was changed to 0.6 mg/dm2.

The press processability, the amount of the lubricant, the printability and the flavor were tested, and the results are shown in Table 1.

EXAMPLE 3

A metallic container was produced and evaluated in the same manner as in Example 1 except that the heat-treatment was carried out at 215° C. for 8 minutes.

The press processability, the amount of the lubricant volatilized, the printability and the flavor were as shown in Table 1.

EXAMPLE 4

The inside and outside surfaces of a steel plate having a thickness of 0.18 mm were coated with 150 mg/dm$^2$ of an epoxy-phenol paint and baking was carried out. Then, branched paraffin was uniformly coated on the plate so that the coated amount of the branched paraffin became 1.0 mg/dm$^2$, and a metallic container was prepared as in Example 1. The metallic container was heat-treated at 220° C. for 4 minutes, and then the amount of the lubricant volatilized, the printability and the flavor were evaluated. The obtained results are shown in Table 1.

As shown in Examples 1 to 4, good results were obtained, and particularly, the printability and the flavor after heat-treatment were excellent. It became clear that the metallic containers prepared by the method of this invention were highly excellent.

COMPARATIVE EXAMPLE 1

For comparison, by using polyethylene glycol (molecular weight of 400) as the lubricant, the same plate as used in Example 1 was uniformly coated with the lubricant so that the coated amount of the lubricant became 1.0 mg/dm$^2$. The plate was drawn as in Example 1. However, the can barrel portion was broken during the press processing, and a metallic container could not be obtained.

COMPARATIVE EXAMPLE 2

In the same way as in Example 1, drawing was performed except that branched paraffin was used as the lubricant and coated uniformly so that the amount of the coating was 0.3 mg/dm$^2$. During the press processing step, the can barrel portion was broken, and a metallic container could not be obtained.

COMPARATIVE EXAMPLE 3

Branched paraffin was used as a lubricant and coated uniformly so that the coated amount became 10.0 mg/dm2. The coated material was drawn in the same way as in Example 1 to form a metallic container. The metallic container was heat-treated at 220° C. for 4 minutes. The amount of the lubricant was measured, and the printability was evaluated. The ink was repelled greatly, and the printability was poor.

COMPARATIVE EXAMPLE 4

Refined palm oil was used as the lubricant and coated uniformly so that the amount coated became 2.0 mg/dm$^2$, and the same drawing operation as in Example 1 was performed to form a metallic container. Then, this container was heat-treated at 220° C. for 4 minutes. The amount of the lubricant volatilized was measured, and the printability and the flavor were evaluated. As a result, some ink repellency was recognized with respect to the printing operation, and the flavor was poor.

The results of Comparative Example 1 to 4 are summarized in Table 2. The conditions of Comparative Examples 1 to 4 as compared with those of Examples 1 to 4, are markedly poor in the drawability or inferior in the printability and flavor, and these conditions cannot be applied to formation of containers.

TABLE 1

| Example No. | Coating Material | Lubricant | Coated Amount | Processability | Heating Condition | Amount Volatilized | Printability | Flavor |
|---|---|---|---|---|---|---|---|---|
| 1 | PET | branched paraffin | 1.0 mg/dm$^2$ | ○ | 220° C.-4 minutes | 0.8 mg/dm$^2$ | ○ | ○ |
| 2 | PET | branched paraffin | 0.6 mg/dm$^2$ | ○ | 220° C.-4 minutes | 0.5 mg/dm$^2$ | ○ | ○ |
| 3 | PET | branched paraffin | 1.0 mg/dm$^2$ | ○ | 215° C.-4 minutes | 0.8 mg/dm$^2$ | ○ | ○ |
| 4 | epoxy-phenol | branched paraffin | 1.0 mg/dm$^2$ | ○ | 220° C.-4 minutes | 0.7 mg/dm$^2$ | ○ | ○ |

TABLE 1-continued

| Example No. | Coating Material | Lubricant | Coated Amount | Processability | Heating Condition | Amount Volatilized | Printability | Flavor |
|---|---|---|---|---|---|---|---|---|
| | paint | | | | | | | |

TABLE 2

| Comparative Example No. | Coating Material | Lubricant | Coated Amount | Processability | Heating Conditions | Amount Volatilized | Printability | Flavor |
|---|---|---|---|---|---|---|---|---|
| 1 | PET | poly-ethylene glycol | 1.0 mg/dm$^2$ | X | — | — | — | — |
| 2 | PET | branched paraffin | 0.3 mg/dm$^2$ | X | — | — | — | — |
| 3 | PET | branched paraffin | 10.0 mg/dm$^2$ | ○ | 220° C.-4 minutes | 3.6 mg/dm$^2$ | X | — |
| 4 | PET | palm oil | 2.0 mg/dm$^2$ | ○ | 220° C.-4 minutes | 1.0 mg/dm$^2$ | Δ | X |

What is claimed is:

1. A method of producing a metallic container comprising:

uniformly coating a thermoplastic resin on a surface of a metallic material with a saturated branched chain containing hydrocarbon lubricant, wherein the branched chains are present in an amount of at least one branch per 2 to 10 carbon atoms of the main chain, and the number of branched chains having one carbon atom is at least 70% of the number of entire branched chains present;

subjecting the coated metallic material to at least one drawing; and heating the can obtained by drawing to volatilize a major portion of the lubricant adhering to the can.

2. A method of producing a metallic container as in claim 1, wherein the thermoplastic resin coating is a thermoplastic resin film coating selected from the group consisting of a polyester and an olefinic resin.

3. A method of producing a metallic container as in claim 2, wherein the polyester is selected from the group consisting of polyethylene terephthalate, polybutylene terephthalate, and an ethylene terephthalate/isophthalate copolymer; and the olefinic resin is selected from the group consisting of polyethylene, polypropylene, an ethylene-propylene-copolymer, an ethylene-vinyl acetate copolymer, an ethylene-acrylate copolymer and an ionomer.

4. A method of producing a metallic container as in claim 1, wherein the amount of the lubricant coated on the surface of the thermoplastic resin coating is 0.4 to 2 mg/dm$^2$.

5. A method of producing a metallic container as in claim 4, wherein the amount of the lubricant coated on the surface of the thermoplastic resin coating is 0.5 t 2 mg/dm$^2$.

6. A method of producing a metallic container as in claim 1, wherein the thermoplastic resin coating further comprises an inorganic filler.

7. A method of producing a metallic container as in claim 1, wherein the thermoplastic resin coating has a thickness of 5 to 40 μm.

8. A method of producing a metallic container as in claim 1, wherein heating is performed at a temperature of 150° to 230° C. and below the melting point and softening point of the resin.

* * * * *